US006794351B2

(12) United States Patent
Shick et al.

(10) Patent No.: US 6,794,351 B2
(45) Date of Patent: Sep. 21, 2004

(54) MULTI-PURPOSE CLEANING ARTICLES

(75) Inventors: Richard L. Shick, Aiken, SC (US); Ali Yahiaoui, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/040,140

(22) Filed: Oct. 19, 2001

(65) Prior Publication Data

US 2002/0147122 A1 Oct. 10, 2002

Related U.S. Application Data

(60) Provisional application No. 60/282,330, filed on Apr. 6, 2001.

(51) Int. Cl.[7] ..... C11D 17/06

(52) U.S. Cl. ..... 510/417; 510/407; 510/424; 510/438; 510/505; 510/506; 252/91; 428/71; 428/198; 428/206; 428/903

(58) Field of Search ..... 510/506, 505, 510/438, 424, 417, 407; 252/91; 428/71, 198, 206, 903

(56) References Cited

U.S. PATENT DOCUMENTS

| | | | | |
|---|---|---|---|---|
| 1,969,900 | A | 8/1934 | Pickett | |
| 3,264,188 | A | 8/1966 | Gresham | |
| 3,965,518 | A | 6/1976 | Muoio | |
| 4,010,252 | A * | 3/1977 | Hewitt | 424/47 |

(List continued on next page.)

FOREIGN PATENT DOCUMENTS

| | | |
|---|---|---|
| EP | 0 032 793 | 7/1981 |
| EP | 0 256 950 | 2/1988 |
| EP | 0 392 316 | 10/1990 |
| EP | 0 365 160 | 12/1994 |
| EP | 0724011 | 7/1996 |
| EP | 0714434 | 3/1997 |
| EP | 0919613 | 6/1999 |
| EP | 0615720 | 9/1999 |
| EP | 1043019 | 10/2000 |
| EP | 1057924 A2 | 12/2000 |
| GB | 0 842 866 | 7/1960 |
| GB | 1 603 047 | 11/1981 |
| WO | 94/09757 | 5/1994 |
| WO | 95/14795 | 6/1995 |
| WO | 95/21238 | 8/1995 |
| WO | 96/06152 | 2/1996 |
| WO | 96/23052 | 8/1996 |
| WO | 98/03623 | 1/1998 |
| WO | 98/12958 | 4/1998 |
| WO | 98/12959 | 4/1998 |
| WO | 98/26040 | 6/1998 |
| WO | 98/28399 | 7/1998 |
| WO | 99/06021 | 2/1999 |
| WO | 99/47105 | 9/1999 |
| WO | 99/48471 | 9/1999 |
| WO | 99/62631 | 12/1999 |
| WO | 00/27271 | 5/2000 |
| WO | 00/36080 | 6/2000 |
| WO | 00/56201 | 9/2000 |

OTHER PUBLICATIONS

AU 97–16595, Abstract, Oct. 1, 1998, Derwent Info Ltd., Miles DGT.

(List continued on next page.)

*Primary Examiner*—Gregory Webb
(74) *Attorney, Agent, or Firm*—Douglas H. Tulley, Jr.; Richard M. Shane

(57) ABSTRACT

Multipurpose cleaning articles are provided comprising a porous cleaning sheet containing an aqueous cleaning composition comprising (a) water as the major component; (b) 5% to 45% by weight water-immiscible solvent; (c) less than about 1.8% by weight emulsifier; and wherein the aqueous cleaning composition has a vertical wicking rate of about 1 cm/minute or more. The porous cleaning sheet can comprise any one of numerous materials, including hydrophobic materials, such as nonwoven webs, textile fabrics, foams and so forth. The cleaning articles are capable of removing water insoluble materials from various surfaces and including cleaning the skin and hands as well as hard surfaces.

32 Claims, 2 Drawing Sheets

U.S. PATENT DOCUMENTS 4,176,080 A * 11/1979 Wise et al. ..... 8/137
4,414,128 A * 11/1983 Goffinet ..... 510/405
4,559,157 A 12/1985 Smith et al.
4,606,840 A * 8/1986 Gautier et al. ..... 510/417
4,659,609 A 4/1987 Lamers et al.
4,725,489 A * 2/1988 Jones et al. ..... 442/121
4,797,310 A * 1/1989 Barby et al. ..... 428/71
4,931,201 A * 6/1990 Julemont ..... 15/104.93
5,043,155 A 8/1991 Puchalski et al.
5,063,062 A 11/1991 Greenspan et al.
5,075,026 A * 12/1991 Loth et al. ..... 510/101
5,130,056 A 7/1992 Jakobson et al.
5,133,897 A 7/1992 Balzer
5,141,803 A 8/1992 Pregozen
5,143,639 A 9/1992 Krawack
5,194,173 A 3/1993 Folkard et al.
5,258,444 A 11/1993 Zezinka et al.
5,380,453 A 1/1995 Krawack
5,397,506 A 3/1995 Groth et al.
5,421,897 A 6/1995 Grawe
5,462,697 A 10/1995 Yianakopoulos
5,494,611 A 2/1996 Howe
5,554,320 A 9/1996 Yianakopoulos
5,660,641 A 8/1997 Howe
5,683,971 A 11/1997 Rose et al.
5,700,768 A 12/1997 Lu
5,770,549 A 6/1998 Gross
5,776,872 A 7/1998 Giret et al.
5,817,585 A 10/1998 Rose et al.
5,906,973 A 5/1999 Ouzounis et al.
5,910,455 A 6/1999 Maddern et al.
5,941,378 A 8/1999 Rose et al.
5,962,001 A 10/1999 Rose et al.
6,028,016 A 2/2000 Yahiaoui et al.
6,107,268 A 8/2000 Yahiaoui et al.
6,136,770 A 10/2000 Cheung et al.
6,136,775 A 10/2000 Strout et al.
6,153,208 A 11/2000 McAtee et al.
6,177,388 B1 1/2001 Cheung et al.
6,204,208 B1 3/2001 Krysik et al.
6,218,345 B1 * 4/2001 Brooks et al. ..... 510/123
6,277,808 B1 * 8/2001 Tcheou et al. ..... 510/417

OTHER PUBLICATIONS

Klaus–P. Wilhelm, *Prevention Of Surfactant–Induced Irritant Contact Dermatitis*, vol. 25, Curr Probl Dermatol. Basel, Karger, pp. 78–85, 1996.

P. Morganti, *Natural Soap and Syndet Bars*, vol. 110, Dermatology Department, University of L'Aquila, Italy, pp. 89–97, 1995.

*Phase Behavior And Microstructure Of Alkyl Polyglucoside Microemulsions*, Internet Article, (Feb. 16, 2001).

*Increasing The Flexibility Of Sugar–Based Surfactants*, Internet Article, (Mar. 1997).

Westvaco Chemical Division, *Westvaco Diacid 1550 Dicarboxylic Acid (Formulary Guide For Limonene Based Cleaners)*, Dec., 2000.

DeSoto, Inc. (Chemical Specialties Division), *Heavy Duty D–Limonene Cleaner*, Dec. 2000, pp. I–3075–I–3076.

Bush Boake Allen, *Terpene Emulsion Cleaning Formulations*, Jul., 1992, pp. 1–2.

* cited by examiner

MULTI-PURPOSE CLEANING ARTICLES

This application claims priority from U.S. Provisional Application No. 60/282,330 filed on Apr. 6, 2001.

BACKGROUND OF THE INVENTION

There are numerous substances used today, both in the workplace and at home, which are difficult to remove once they adhere to a surface. As examples, commonly used materials include oil, grease, ink, paint, tar, caulking and sealing compounds, adhesives and glues, coal dust, pitch, varnishes, and so forth. These and like materials are often difficult to remove from the skin and other surfaces because they are not miscible in water and therefore not readily removed with common cleaners such as soap and water. In this regard, numerous cleaning compositions have heretofore been specifically formulated to help remove such materials. These cleaning compositions typically include one or more solvents that help to dissolve and/or solubilize many water-immiscible materials such as grease, inks and so forth.

However, many solvents are themselves immiscible in water. Nevertheless, stable and substantially homogeneous cleaning compositions containing water and water-immiscible solvents are well known in the art. The stability and homogeneity are often achieved through the use of one or more surface-active agents to form an emulsion. Terpenes, for example, are immiscible in water and are therefore commonly used in aqueous cleaning compositions in combination with one or more emulsifiers. As an example, aqueous emulsions using d-limonene as the solvent or cleaning component are described in Coleman, *D-Limonene As A Degreasing Agent*, The Citrus Industry, vol. 56, No. 11, November 1975. Coleman's hand cleaning lotion, for example, includes water, d-limonene, lanolin and about 15% or more of several non-ionic surfactants. Similarly, U.S. Pat. No. 4,620,937 to Dellutri teaches an all purpose cleaner comprising a mixture of d-limonene, stearic and oleic acids, non-ionic detergents and water. In Dellutri's preferred example, the non-ionic detergents comprise approximately 7.5% of the cleaning agent. In addition, U.S. Pat. No. 4,511,488 to Matta teaches a homogeneous aqueous cleaning composition including water, d-limonene, a coupling agent and 10 to 30% by weight of a surfactant. By utilizing the particular combination of ingredients, Matta forms a cleaning composition that is clear, homogenous and readily flowable despite the inclusion of a water-immiscible solvent such as d-limonene.

In addition, various cleaning articles have likewise been used in combination with liquid cleaners to aid in cleaning surfaces. By way of example, various wipes and cleaning articles are described in U.S. Pat. No. 4,100,324 to Anderson et al.; U.S. Pat. No. 4,436,780 to Hotchkiss et al., U.S. Pat. No. 4,659,609 to Lamers et al., U.S. Pat. No. 4,853,281 to Win et al., U.S. Pat. No. 4,833,003 to Win et al. and PCT Publication WO 00/56201. Further, saturated or pre-moistened papers, nonwovens, textiles and other substrates have been used in a variety of wiping and cleaning applications. Cleaning sheets or wipes are often provided in a sealed container and retrieved therefrom in a saturated or moist condition (i.e. pre-moistened). The pre-moistened substrate releases the retained liquid when used to clean the desired surface.

With regard to the foregoing liquid cleaners and articles, emulsifiers are often critical components of the same due to their ability to solubilize the solvent and also to help the cleaning liquid wet out hydrophobic surfaces. In addition, the emulsifiers likewise help loosen water-immiscible materials from the surface as well as solubilize the same thereby helping to keep them from being re-deposited upon the cleaned surface. However, many emulsifiers also have the undesirable affect of "de-fatting" the skin. In this regard, many emulsifiers draw fat from the skin and thereby detrimentally effect the skin's ability to retain moisture. The "de-fatting" of skin by emulsifiers is a phenomena described in the following articles: Wilhelm, K., *Prevention of Surfactant-Induced Irritant Contact Dermatitis*, Current Problems in Dermatology, vol. 25, pp. 78–85 (1996); Morganti, P., *Natural Soap and Syndet Bars*, Cosmetics & Toiletries Magazine, vol. 110, (November 1996). Thus, exposure to significant amounts of emulsifiers can result in dry and/or damaged skin.

While there exists a wide range of aqueous cleaners and/or cleaning articles that incorporate one or more water-immiscible solvents, there remains a need for aqueous cleaning compositions and articles containing the same that effectively clean while limiting the physical and/or chemical disturbance to the skin. Further, there remains a need for such articles incorporating such cleaning compositions that contain an effective amount of the cleaning composition. Still further, there remains a need for such cleaning compositions and articles incorporating the same that have good shelf lives and can be made safely and economically.

SUMMARY OF THE INVENTION

The aforesaid needs are fulfilled and the problems experienced in the prior art overcome by the cleaning articles of the present invention which comprise a porous material containing an aqueous cleaning composition and wherein the aqueous cleaning composition comprises (a) at least about 25% water; (b) at least about 5% water-immiscible solvent; and (c) no more than 1.8% emulsifier. The aqueous cleaning composition desirably has a drop test of less than 3 seconds and/or has a vertical wicking rate of at least 0.9 cm/minute. In a further aspect, the aqueous cleaning composition may further contain between about 2% and 20% of a hydrotrope. Still further, the aqueous cleaning composition may further comprise between about 0.1% and about 20% of a humectant. In an exemplary embodiment, the porous material is a hydrophobic material such as, for example, a fabric of thermoplastic polymer fibers. Still further, a plurality of cleaning sheets may be provided in a stack and the aqueous cleaning composition distributed throughout the stack. Desirably, each cleaning sheet forming the stack contains at least 100 weight % of the aqueous cleaning composition, based upon the weight of the dry sheet.

DEFINITIONS

Figure 1:
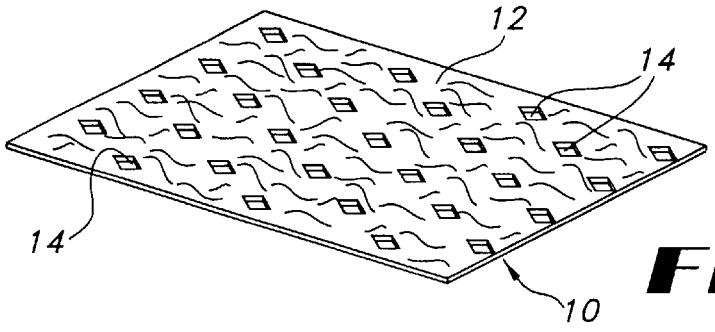
FIG. 1 is a partially elevated perspective view of a point bonded nonwoven wipe.

As used herein, the term "comprising" is inclusive or open-ended and does not exclude additional unrecited elements, compositional components, or method steps. Accordingly, the term "comprising" encompasses the more restrictive terms "consisting essentially of" and "consisting of."

As used herein, the term "emulsifier" means an agent capable of forming an oil-in-water or water-in-oil emulsion with a water-immiscible solvent.

As used herein, the term "water-immiscible" means that the substance has a solubility of less than 0.1%, by weight, in water at ambient conditions.

As used herein the term "fabric" means a material comprising a network of fibers including, but not limited to, woven or knitted materials, tufted or tufted-like materials, nonwoven webs, and so forth.

As used herein the term "nonwoven" fabric or web means a structure of individual fibers or threads which are interlaid, but not in an identifiable manner as in a knitted or woven fabric. Nonwoven fabrics or webs have been formed by many processes such as, for example, meltblowing processes, spunbonding processes, hydroentangling, airlaid, and carding processes.

As used herein, the term "porous material" includes those materials having open areas or interstitial spaces located therein; the open areas or interstitial spaces need not extend through the entirety of the material.

As used herein, the term "machine direction" or MD means the direction of the fabric in the direction in which it is produced. The term "cross machine direction" or CD means the direction of the fabric substantially perpendicular to the MD.

As used herein, the term "liquid" is used in accord with its normal understanding of the term and refers to liquids generally regardless of form and includes solutions, emulsions, suspensions and so forth.

As used herein, all percentages, ratios and proportions are by weight unless otherwise specified.

DESCRIPTION OF THE INVENTION

The aqueous cleaning composition of the present invention includes, as its major component, water. Desirably, the aqueous cleaning composition comprises at least 25% water and still more desirably comprises at least 50% water. In addition to water, the cleaning composition includes one or more water-immiscible solvents. In this regard, numerous water-immiscible solvents are known in the art. Desirably the cleaning composition includes one or more water-immiscible solvents comprising between about 5% and about 45% of the cleaning composition and still more desirably comprising between about 5% and about 20% of the cleaning composition. Examples of water immiscible solvents suitable for use with the present invention include, but are not limited to, dibasic esters, emollient esters and diesters, terpenes, mineral oils, naphthas, glycol ethers, paraffinic and isoparaffinic hydrocarbons, aliphatic hydrocarbons, aromatic hydrocarbons, petroleum distillates, vegetable oils (i.e. plant oils, nut oils, seed oils, etc.), vegetable oil esters, animal oils, organic halides, silicones, halogenated solvents, alcohols, and derivatives thereof. It will be appreciated that a single water-immiscible solvent or a combination of two or more water immiscible solvents can be included within the cleaning composition of the present invention. As used herein, the term "dibasic ester" refers to an ester containing two hydrogens that may be replaced by a monovalent metal or radical. Examples of dibasic esters include, but are not limited to, dimethylgluterate, dimethyladipate, and dimethylsuccinate. Exemplary vegetable or animal oils include, but are not limited to, soybean oil, sunflower oil, olive oil, lanolin, tall oil, pine oil, orange oil, and derivatives thereof. Further, exemplary terpenes include, but are not limited to, d-limonene and dipentene.

In addition to the water-immiscible solvents, one or more water-soluble solvents may also be added to the cleaning composition. Exemplary water-soluble solvents include, but are not limited to, octyl cocoate, isosorbide, dimethylisosorbide, mono and polyhydric alcohols, glycol ethers and so forth. Desirably, water-soluble solvents are used in amounts between about 0.1% and 20%.

Exemplary emulsifiers suitable for use with the present invention include, but are not limited to, polysaccharide ethers, polyglycosides, fatty acids, fatty alcohols, amine oxides, water-soluble cellulose derivatives, alkyl sulfonates, ethoxylated alkyl phenols, alkanaolamides, betaines, zwiterionics, carboxylated alcohols, carboxylic acids, ethoxylated alcohols, and derivatives thereof. It will be appreciated that a single emulsifier or a combination of two or more emulsifiers can be included within the cleaning composition of the present invention. The one or more emulsifiers are desirably present in the cleaning composition in an amount of 1.8% or less and still more desirably comprise between about 0.5% and 1.6% of the cleaning composition and even still more desirably comprise between about 0.8% and 1.5% of the cleaning composition.

Polyglycosides are known in the art and, as indicated above, are well suited for use as an emulsifier in the present invention. Desirably, the polyglycoside comprises an alkyl polyglycoside and even more desirably an alkyl polyglycoside having from about 8 to about 10 carbons in the alkyl chain. Exemplary polyglycosides are disclosed in U.S. Pat. Nos. 3,547,828; 3,598,865; 3,772,269; 4,939,245; 5,385,750 and 5,567,808; the entire contents of each of the aforesaid references are incorporated herein by reference. Alkyl polyglycosides are commercially available and, by way of example only, are commercially available under the trade names APG, GLUCOPON and PLANTAREN from Cognis Corporation of Ambler, Pa. An exemplary alkyl polyglycoside is a D-glucopyranoside having a $C_{10}$–$C_{16}$ alkyl substituent such as that offered by Cognis Corporation under the trade name GLUCOPON 600UP. An additional exemplary alkyl polyglycoside is octylpolyglycoside, such as that offered by Cognis Corporation under the trade name GLUCOPON 220UP, having a degree of polymerization of about 1.4 and the following chemical formula:

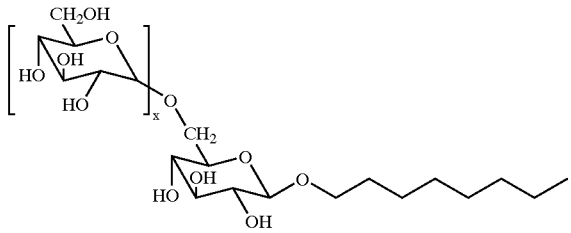

(x = 0–3)

Amine oxides are likewise known in the art and also well suited for use as an emulsifier in the cleaning compositions of the present invention. Exemplary amine oxides include, but are not limited to, those derivatives formed from the following fatty acids: octyl, decyl, lauryl, cetyl, myristal, stearyl, olleyl, linoleyl and linolenyl. In addition, exemplary amine oxides include, by way of example only, behenamine, cocamine, cocamidopropylamine and so forth.

By way of example only, additional emulsifiers suitable for use in the present invention include sodium deodecylbenzene sulfate, cocamide DEA, cocamidopropylbetaine, oleobetaine, octylphenoxypolyethoxyethanol, and tridecyl ether alcohols. Further, an exemplary commercially available fatty alcohol is HETOXOL TD-6 (trideceth-6) available from Heterene, Inc. of Paterson, N.J.

In addition, one or more hydrotropes can also be included in the aqueous cleaning composition. Desirably the hydrotropes comprise less than about 20% of the cleaning composition and still more desirably between about 2% and about 10% of the cleaning composition and even still more desirably comprise between about 2% and about 6% of the cleaning composition. As used herein, the term "hydrotrope" is exclusive of emulsifying agents and includes those agents that have the property of increasing the aqueous solubility of one or more slightly soluble organic chemicals. Hydrotropes suitable for use in the present invention include, but are not limited to, salts of sulphonic acids, alkyl phosphates and so forth. Exemplary salts of sulphonic acids include those formed from xylene, cumene and tolulene. Further, exemplary alkyl phosphates desirably have an alkyl chain having about six carbon atoms or less.

In addition, one or more wetting agents can likewise be added to the cleaning composition. As used herein the term "wetting agents" is exclusive of emulsifying agents and includes those agents that have the property of improving the ability of water to more easily penetrate into or spread over a surface by reducing the surface tension of the water. Desirably, the cleaning composition includes less than about 10% wetting agents and still more desirably between about 1% and about 6% wetting agents. Exemplary wetting agents include, but are not limited to, propylene glycol and methyl propanediol, isopropyl alcohol, ethyl alcohol, hexylene glycol, dipropylene glycol, tripropylene glycol, propylene glycol methyl ether, dipropylene glycol methyl ether, tripropylene glycol methyl ether, propylene glycol propyl ether, and water-soluble glycol ethers such as ethylene glycol butyl ether and diethylene glycol butyl ether.

In addition, one or more humectants can likewise be added to the cleaning composition. Humectants suitable for use with the present invention include, but are not limited to, glycerols, ethoxylated glycerols, sodium lactate, acetomid monoethylamine and so forth. Desirably the humectants are present in an amount between about 0.1% and about 20% of the cleaning composition and still more desirably in an amount between about 2% and about 8% of the cleaning composition.

The cleaning composition may further include an effective amount of one or more additional components and including, but not limited to, thickeners, preservatives, emollients, moisturizers, skin conditioners, fragrances, colorants and so forth. Further, the cleaning composition may further include an effective amount of one or more antiseptics, antimicrobial and/or antibiotic agents such as, for example, benzylthonium chloride, diphenyl ether (bisphenyl) derivatives (e.g. 2,4,4'-trichloro-2'-hydroxydiphenyl ether), chloroxylenols, alkyl esters of hydroxybenzoic acid and so forth. Numerous antimicrobial agents are commercially available such as, for example, those available under the trade names PARABEN, PCMX and TRICLOSAN. Still further, the cleaning composition may further include an effective amount of one or more anti-irritants such as, for example, chamomile, allantoin, and so forth.

The aqueous cleaning composition is desirably applied to a porous material in order to form a cleaning article. Exemplary porous materials include, but are not limited to, nonwoven webs, multilayer laminates, open cell foams, woven and knitted materials and so forth. Desirably, the porous material includes individual openings or interstitial spaces that collectively form pathways through the thickness of the material via adjacent, inter-connecting spaces or openings. The aqueous cleaning composition is desirably applied to the porous material in order to pre-moisten or saturate both the exterior and interior portions of the same. Further, the porous material is desirably a fibrous sheet having numerous interstitial spaces throughout the fabric. In a further aspect, the cleaning compositions disclosed herein are also suitable for use within porous materials formed from and/or comprising a hydrophobic material. As used herein, the term "hydrophobic" includes those materials having a contact angle greater than 45 degrees. However, many hydrophobic materials suitable for use in the present invention may have a contact angle of about 60 degrees or more and, still more desirably, may have a contact angle of about 90 degrees or more. Suitable hydrophobic materials include, but are not limited to, those formed from polyolefins, polyesters, polyamides and like polymers. As an example, the porous material may comprise propylene polymers. Exemplary nonwoven fabrics can be formed by many processes such as, for example, meltblowing processes, spunbonding processes, hydroentangling processes, air-laid processes, bonded carded web processes and so forth. In addition, the porous material can comprise a multi-layer laminate of one or more different materials. By way of example only, materials suitable for use with the present invention include, but are not limited to, those described in U.S. Pat. No. 4,100,324 to Anderson et al.; U.S. Pat. No. 4,298,649 to Meitner; U.S. Pat. No. 4,463,780 to Hotchkiss et al.; U.S. Pat. No. 4,659,609 to Lamers et al; U.S. Pat. No. 4,853,281 to Abba et al.; U.S. Pat. No. 4,833,003 to Win et al.; U.S. Pat. No. 5,382,400 to Pike et al.; U.S. Pat. No. 5,895,710 to Sasse et al.; U.S. Pat. No. 5,605,749 to Pike et al.; U.S. Pat. No. 5,858,504 to Fitting; U.S. Pat No. 5,759,926 to Pike et al., U.S. patent application Ser. No. 09/760,962 to Marmon et al. and U.S. patent application Ser. No. 09/531,300 to Keck et al.; the entire content of each of the aforesaid references is incorporated herein by reference. The size and shape of the porous material can vary as desired and will often be selected in accord with the nature of the surface to be cleaned. The materials may be bonded or otherwise modified to achieve the desired strength, durability and/or texture as is known in the art. As an example and with reference to FIG. 1, a nonwoven sheet 10 can be point bonded to provide a nonwoven fabric 12 having numerous small, discrete bond points 14. By way of example only, the porous materials will often have a basis weight between about 10 to about 350 grams/square meter (gsm) and even more desirably a basis weight between about 15 to about 200 gsm and even still more desirably between about 20 to about 100 gsm.

The cleaning composition is suitable for use in combination with a wide range of porous materials and, further, is suitable for use in combination with hydrophobic porous materials and/or cleaning of hydrophobic surfaces. In this regard, the cleaning composition desirably has a drop test, described hereinafter, of less than 3 seconds and still more desirably less than about 1 second. In addition, the cleaning composition desirably has a vertical wicking rate of at least about 0.9 cm/minute (based upon the vertical wicking test at 7 minutes) and still more desirably has a vertical wicking rate of at least about 1.0 cm/minute, even still more desirably has a vertical wicking rate of at least about 1.2 cm/minute, and even still more desirably a vertical wicking rate of about 1.4 cm/minute or more. Thus, the aqueous cleaning composition is readily held or contained within porous hydrophobic materials and further the cleaning composition can be substantially uniformly distributed within and throughout the porous material.

Many porous materials can be pre-moistened and/or saturated with the aqueous cleaning composition wherein the cleaning composition is retained throughout a stack over extended periods of time. Thus, stacked materials can be pre-moistened and then stored in a sealed container until needed. In this regard, wipers or sheets taken throughout the stack desirably each contain at least about 100 weight % liquid (based upon the dry weight of the sheet). Further, sheets throughout the stack desirably contain substantially the same amount of the cleaning composition. In this regard the stack of sheets desirably experience insubstantial liquid migration over time and, in particular, avoids migration wherein the upper portion of the stack contains significantly less liquid relative to the amount of liquid within the lower portion of the stack. Thus, the sealed container can hold the pre-moistened sheets such that the stacked sheets, from top to bottom, each contain an effective amount of cleaning liquid even when experiencing extended storage and/or shipping times.

As used herein, the term "stack" is used broadly to include any collection of wipers or sheets wherein there is a plurality of surface-to-surface interfaces. This not only includes a vertically stacked collection of individual sheets, but also includes a horizontally stacked collection of individual sheets as well as a rolled or folded collection of continuous sheet material. In the case of a horizontal stack in accordance with this invention, where the individual sheets are standing on edge, the concentration of the cleaning composition is desirably maintained substantially equal from the top to the bottom of each individual sheet, as well as from sheet to sheet. A rolled or folded product comprising a continuous sheet desirably has perforated or over-bonded lines of weakness which allow separation into smaller individual sheets of a desired shape and size. Notably, when wound into a roll, the concentration of the cleaning composition within the roll of wipes or sheets equilibrates to substantially equal concentrations, regardless of the orientation of the roll within a container.

Figure 2:
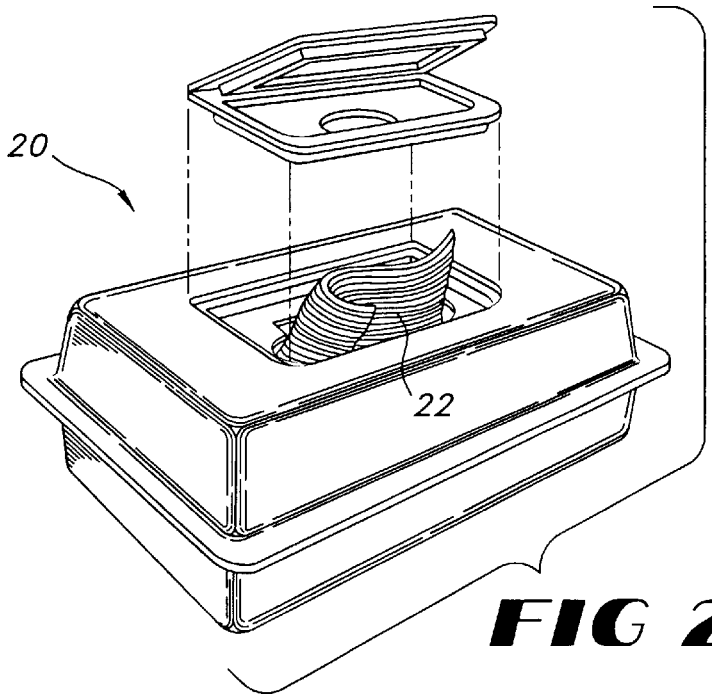
FIG. 2 is a perspective view of a sealable container and wipes.
Figure 2A:
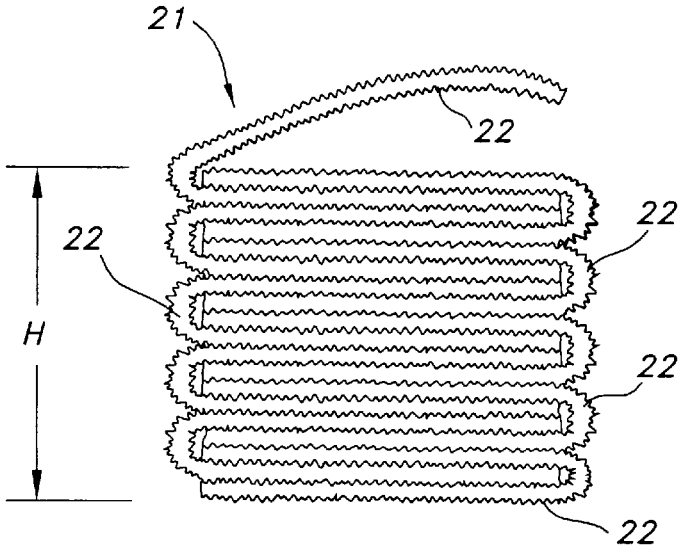
FIG. 2A is an exposed side view of the stacked wipes of FIG. 2.

The stack desirably has at least about 10 layers and more desirably has between about 10 and about 250 layers and still more desirably between about 20 and about 200 layers. As used herein, "layers" refer to the number of fabric interfaces. In this regard, a rolled sheet will be considered to have a fabric interface or "layer" for each revolution. Further, a sheet folded one or more times will likewise create additional fabric interfaces or layers; as an example, 20 individual superposed sheets in half folds (e.g. folded in half) create 39 layers. With reference to FIGS. 2 and 2A, the stack height (H) is the height of the superposed sheets 22 within the container 20.

The wet, stacked sheets can be maintained over time in a sealed container such as, for example, within a bucket with an attachable lid, sealable plastic pouches or bags, canisters, jars, tubs and so forth. Desirably the wet, stacked sheets are maintained in a resealable container. The use of a resealable container is particularly desirable when using highly volatile liquid compositions since substantial amounts of liquid can evaporate while using the first sheets thereby leaving the remaining sheets with little or no liquid. Exemplary resealable containers and dispensers include, but are not limited to, those described in U.S. Pat. No. 4,171,047 to Doyle et al., U.S. Pat. No. 4,353,480 to McFadyen, U.S. Pat. No. 4,778,048 to Kaspar et al., U.S. Pat. No. 4,741,944 to Jackson et al., U.S. Pat. No. 5,595,786 to McBride et al.; the entire contents of the aforesaid references are incorporated herein by reference. The sheets can be incorporated or oriented in the container as desired and/or folded as desired in order to improve efficiency of use as is known in the art.

A selected amount of the aqueous cleaning composition is added to the porous materials and/or container such that the cleaning articles contain the desired amount of the liquid cleaning composition. The amount of cleaning composition added to the porous material comprising the sheets or wipers will vary with the desired application and/or function of the moistened cleaning articles. Typically, the stacked sheet material is placed or formed in the container and the liquid subsequently added thereto. The pre-moistened cleaning article, e.g. a wiper, can thereafter be used to treat a surface as desired. The moistened and/or saturated cleaning articles of the present invention can be used to treat various surfaces. As used herein "treating" surfaces is used in the broad sense and includes, but is not limited to, wiping, polishing, swabbing, cleaning, washing, disinfecting, scrubbing, scouring, sanitizing, and/or applying active agents thereto. The pre-moistened sheets or wipers of the present invention are capable of removing foreign matter from various surfaces. By way of non-limiting examples, foreign matter includes substances such as oil, grease, ink, paint, tar, caulking and sealing compounds, adhesives and glues, coal dust, pitch, varnishes, and so forth. In addition, by way of example only, the pre-moistened sheets or wipers are well suited to treating hard surfaces such as, for example, counters, tables, furniture, workstations, windows, lab tops, equipment, machinery, floors, walls and so forth. Suitable hard surfaces include metal, glass, wood, stone, plastic, and so forth. In addition, the sheets or wipers can also be used to treat various other surfaces such as, for example, treating skin. In this regard, pre-moistened sheets or wipes and, in particular, nonwoven webs are well suited for use in hand cleaning.

Test Description

Drop Test: A 34 g/m$^2$ sheet of a meltblown web of polypropylene fibers, made in accord with U.S. Pat. No. 4,833,003, is laid flat on a horizontal screen. A 1 milliliter drop of the cleaning composition was added to the surface of the sheet at a height between 1.25 and 2.5 cm above the sheet. The rate at which the drop absorbed into and spread over the fabric was then observed. The time it took for the drop to fully absorb into the sheet and/or spread to a diameter of 1.25 cm was measured.

Figure 3:
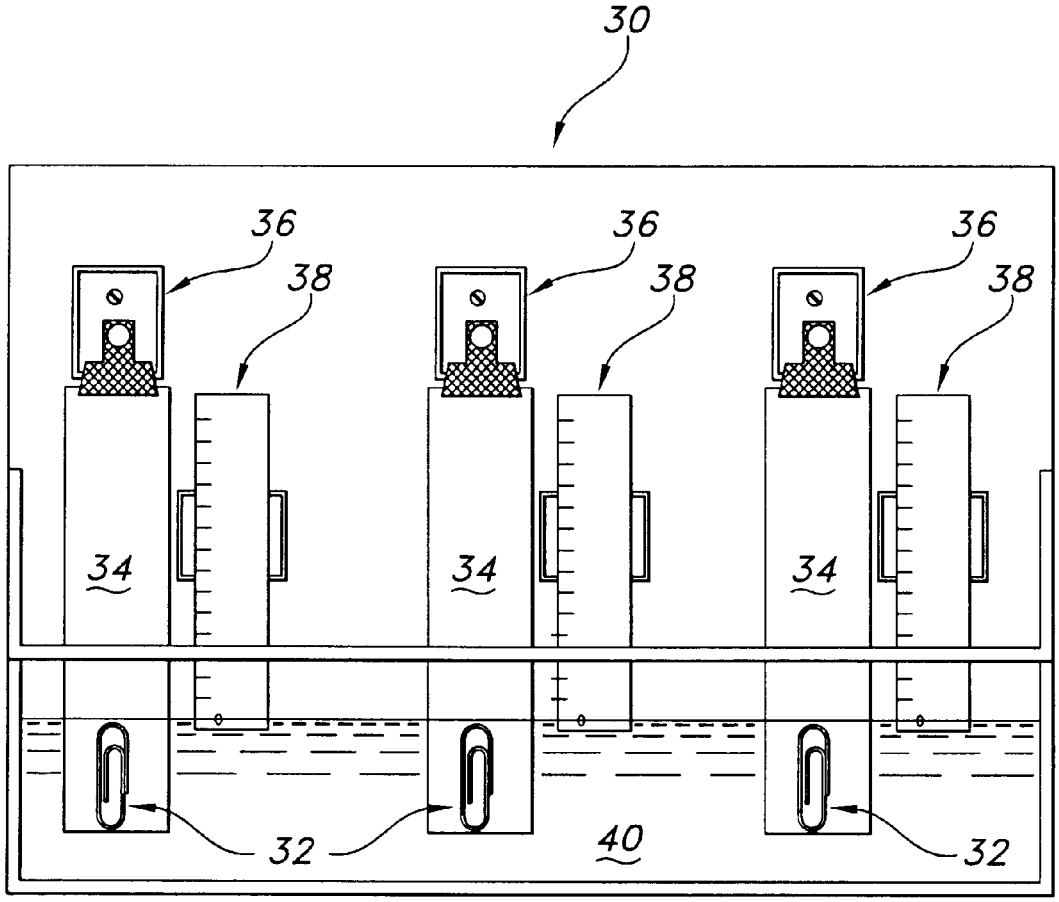
FIG. 3 is a side view of an apparatus suitable for determining vertical wicking properties.

Vertical Wicking Test: A 34 g/m$^2$ sheet of a meltblown fiber web of polypropylene fibers, made in accord with U.S. Pat. No. 4,833,003, is cut into 2.5 cm×20 cm (1 inch×8 inch) specimens. The specimens are cut so that the machine direction of the fabric runs in the lengthwise direction. A reservoir or jar containing the cleaning composition is provided. One end of the specimen is clamped and the other end is placed in the fluid such that it extends 2.5 cm therein. An apparatus 30 can be used similar to that depicted in FIG. 3. A paper clip 32 or other weight may be used to weigh the lower end of the specimen 34 and prevent the specimen from curling and allow the specimen to readily submerge in the liquid cleaning composition 40. Support blocks 36 maintain the specimen at a fixed height. The degree of liquid migration in centimeters is measured at 7 minutes. A ruler 38 or other device can be used to determine the degree of liquid migration up the specimen.

EXAMPLES

Example 1

An aqueous cleaning composition was made by mixing the following ingredients in the amounts as indicated (percent is by weight): 8.8% d-limonene; 3.0% sunflower seed oil; 2.0% propylene glycol; 1.5% alkyl polyglycoside; 1.0% coco-caprylate/caprate; 0.1% butylated hydroxytoluene; 0.7% preservative and anti-microbial agent; 82.9% water. The ingredients were mixed at ambient temperature and then immediately added to a bucket containing a roll of perforated 34 g/m$^2$ polypropylene meltblown fiber sheets having a height of about 16 cm. The meltblown fiber sheets were made in accord with U.S. Pat. No. 4,833,003 to Win et al. The aqueous cleaning composition migrated throughout the rolled fabric thereby wetting out and moistening each of the sheets forming the roll.

Example 2

An aqueous cleaning composition was made by mixing the following ingredients in the amounts as indicated (percent is by weight): 8.8% d-limonene; 3.0% sunflower seed oil; 2.0% glycerin; 1.5% trideceth-6; 1.0% coco-caprylate/caprate; 0.1% butylated hydroxytoluene; 0.7% preservative and anti-microbial agent; and 82.9% water. The ingredients were mixed at ambient temperature and then immediately added to a bucket containing a roll of perforated 34 g/m$^2$ meltblown fiber sheets having a height of about 16 cm. The meltblown fiber sheets were made in accord with U.S. Pat. No. 4,833,003 to Win et al. The aqueous cleaning composition migrated throughout the rolled fabric thereby wetting out and moistening each of the sheets forming the roll.

While various patents and other reference materials have been incorporated herein by reference, to the extent there is any inconsistency between incorporated material and that of the written specification, the written specification shall control. In addition, while the invention has been described in detail with respect to specific embodiments and/or examples thereof, it will be apparent to those skilled in the art that various alterations, modifications and other changes may be made to the invention without departing from the spirit and scope of the present invention. It is therefore intended that the claims cover or encompass all such modifications, alterations and/or changes.

We claim:

1. A cleaning article, comprising:

a porous material containing an aqueous cleaning composition;

said aqueous cleaning compositIon comprising (a) at least about 25% by weight water, (b) between 5% and 45% by weight water-immiscible solvent; (c) between 0.5% and 1.6% by weight emulsifier; and wherein said aqueous cleaning composition has a vertical wicking rate of at least 0.9 cm/minute.

2. The cleaning article of claim 1 wherein said porous material comprises a hydrophobic material.

3. The cleaning article of claim 2 wherein said aqueous cleaning composition further contains between about 0.5% and 20% of a hydrotrope.

4. The cleaning article of claim 2 wherein the water-immiscible solvent is selected from the group consisting of vegetable oils, animal oils, mineral oils, vegetable oil esters, emollient esters, emollient diesters, glycol ethers, terpenes, petroleum distillates and derivatives thereof.

5. The cleaning article of claim 2 wherein said emulsifier is selected from the group consisting of polyseecharide ethers, polyglycosides, fatty acid derivatives, fatty alcohols, amine oxides, water-soluble cellulose derivatives, ailcyl sulfonates, ethoxylated alkyl phenols, alkanaolamides, betaines, zwiterionics, carboxylated alcohols, carboxylic acids, ethoxylated alcohols, and derivatives thereof.

6. The cleaning article of claim 4 wherein said emulsifier comprises a fatty alcohol.

7. The cleaning article of claim 4 wherein said emulsifier comprises tridecyl ether alcohol.

8. The cleaning article of claim 4 whereIn said emulsifier comprises an alkylpolyglycoside.

9. The cleaning article of claim 4 wherein said emulsifier comprises an amine oxide.

10. The cleaning article of claim 4 wherein said emulsifier comprises a carboxylic acid or a derivative thereof.

11. The cleaning article of claim 4 wherein said water-immiscible solvent comprises a terpene.

12. The cleaning article of claim 5 wherein the water comprises at least 50% by weight of the aqueous cleaning composition and further wherein the water-immiscible solvent comprises between about 5% and about 20% by weight of the aqueous cleaning composition.

13. The cleaning article of claim 12 wherein said aqueous cleaning composition further comprises between 1% and 10% by weight of a wetting agent.

14. The cleaning article of claim 12 wherein said aqueous cleaning composition comprises between about 0.1% and about 20% by weight of a humectant.

15. The cleaning article of claim 12 wherein said porous material comprises a hydrophobic nonwoven web of thermoplastic polymer fibers and further wherein said aqueous cleaning composition has a drop test of less than 3 seconds.

16. The cleaning article of claim wherein said porous hydrophobic material comprises a meltblown nonwoven web of olefin polymer fibers.

17. A cleaning article comprising:

a porous hydrophobic fabric comprising thermoplastic polymer fibers and wherein said fabric contains an aqueous cleaning composition therein;

said aqueous cleaning composition comprising (a) at least about 50% by weight water, (b,) 5% to 45% by weight water-immiscible solvent; (c) between 0.5% and 1.6% by weight emulsifier; and wherein said aqueous cleaning composition has a vertical wicking rate of at least 1 cm/minute.

18. The cleaning article of claim 17 wherein said emulsifier is selected from the group consisting of fatty alcohols, amine oxides and polyglycosides.

19. The cleaning article of any of claim 18 wherein said water-immiscible solvent is selected frown the group consisting of vegetable oils, animal oils, mineral oils, vegetable oil esters, emollient esters, emollient diesters, glycol ethers, petroleum distillates and derivatives thereof.

20. The cleaning article of claim 19 wherein said water-immiscible solvent comprises a terpene.

21. The cleaning article of claim 20 wherein said water-immiscible solvent comprises between about 5% and about 20% by weight of the aqueous cleaning composition.

22. The cleaning article of claim 21 wherein said porous fabric comprises a meltblown nonwoven web of olefin polymer fibers.

23. The cleaning article of claim 17 wherein said emulsifier is selected from the group consisting of polysacoharide ethers polyglycosides, fatty acid derivatives, fatty alcohols, amine oxides, water-soluble cellulose derivatives, alkyl sulfonates, ethoxylated alkyl phenols, alkanaolamides, betaines, zwiterionics, carboxyisted alcohols, carboxylic acids, ethoxylated alcohols, end derivatives thereof.

24. The cleaning article of claim 23 wherein said aqueous cleaning composition further comprises between 0.5% and 20% of a hydrotrope and between 1% and 10% of a wetting agent.

25. The cleaning article of claim 17 wherein said water-immiscible solvent includes a terpene and a vegetable oil.

26. The cleaning composition of claim 21 wherein said water-immiscible solvent includes a terpene and a vegetable oil selected from the group consisting of soybean oil, sunflower oil and olive oil.

27. Cleaning articles comprising:

a stack of sheets, wherein said sheets comprise a porous material;

a cleaning composition distributed throughout said stack, wherein said cleaning composition comprises (a) at least about 25% by weight water; (b) between 5% and 45% by weight water-immiscible solvent; (c) between 0.5% and 1.6% by weight emulsifier.

28. The cleaning articles of claim 27 wherein said sheets comprise a nonwoven web including hydrophobic thermoplastic fibers.

29. The cleaning articles of claim 28 wherein the sheets in said stack contain at least 100% by weight of said aqueous cleaning composition, based upon the dry weight of said sheet.

30. The cleaning articles of claim 28 wherein said aqueous cleaning composition further comprises between 0.5% and 20% of a hydrotrope and between 1% and 10% of a wetting agent.

31. The cleaning article of claim 30 wherein said emulsifier is selected from the group consisting of fatty alcohols, amine oxides and polyglycosides.

32. The cleaning articles of claim 31 wherein the aqueous cleaning composition is substantially uniformly distributed throughout said stack.

* * * * *